United States Patent [19]

Tischer

[11] Patent Number: 4,588,921

[45] Date of Patent: May 13, 1986

[54] VACUUM-FLUORESCENT DISPLAY MATRIX AND METHOD OF OPERATING SAME

[75] Inventor: Kurt M. Tischer, Wendlingen, Fed. Rep. of Germany

[73] Assignee: International Standard Electric Corporation, New York, N.Y.

[21] Appl. No.: 672,154

[22] Filed: Nov. 16, 1984

Related U.S. Application Data

[63] Continuation of Ser. No. 340,929, Jan. 20, 1982, abandoned.

[30] Foreign Application Priority Data

Jan. 31, 1981 [DE] Fed. Rep. of Germany ..... 3103293

[51] Int. Cl.[4] ..... H01J 1/62; H01J 63/04

[52] U.S. Cl. ..... 313/496; 313/585

[58] Field of Search ..... 313/582, 585, 495, 496, 313/497, 500, 505, 510, 514; 315/169.4

[56] References Cited

U.S. PATENT DOCUMENTS 4,122,376 10/1978 Mera et al. ..... 313/496

*Primary Examiner*—William L. Sikes
*Assistant Examiner*—Robert E. Wise
*Attorney, Agent, or Firm*—T. L. Peterson; J. M. May

[57] ABSTRACT

The invention relates to the construction and the mode of operation of vacuum-fluorescent display matrices which, as regards size and manufacturing investment, can compete with LCD versions and have the added advantage of being self-luminous. Between a rear wall plate and a closely adjacent transparent front plate which are both provided on their insides with transparent conductor leads, only the filaments are disposed. The fluorescent material (phosphor) is deposited as spaced segments on the conductor leads of the front plate. For activating the fluorescent segments, the electron stream is redirected, by reversing the polarity of the associated conductor leads, from the rearward electrode to the fluorescent segments on the front plate. Matrix addressing serves the selection of the character elements.

10 Claims, 3 Drawing Figures

VACUUM-FLUORESCENT DISPLAY MATRIX AND METHOD OF OPERATING SAME

BACKGROUND OF THE INVENTION

This is a continuation of application Ser. No. 340,929 filed Jan. 20, 1982, and now abandoned.

The present invention relates to a flat type vacuum-fluorescent display matrix with two plates forming the housing walls with at least one of the plates being transparent, transparent conductors provided at least on the inside of the transparent plate and electrodes disposed between the two plates, and to a method of operating same.

It is customary in the construction of vacuum-fluorescent displays to arrange in front of each row of characters containing e.g., 5 times 7 fluorescent segments, one row of sufficiently transparent control grids. In front of these, thin cathode wires are disposed. The corresponding fluorescent segments of all characters are connected with each other by way of conductor leads. By controlling the central grid on the one hand, and the row of identical fluorescent segments on the other hand, it is possible by way of multiplexing, to control the characters of one row differently. The extension (number of characters) of such an arrangement is restricted, and the construction of a matrix composed of several rows of characters would be very expensive.

When constructing e.g., seven-segment displays, a very close arrangement of "character elements" is of no significance, because for reasons of legibility, the figures, letters and symbols must always have a reasonable size. In distinction thereto, for presenting arbitrary patterns, the subdivision (resolution) should be finer when the character shapes to be displayed are more versatile.

Finally, for image reproduction, a comparatively high resolution must be accomplished with the aid of numerous, identical and regularly arranged "picture points". The present state of development in this particular field of technology has been summarized and described in detail in NTZ Vol. 30 (1977), No. 3 by W. Veith: "Flacher Bildschirm"; NTZ Vol. 33 (1980), Nos. 2,3 and 4 by A. Fischer: "Flache Bildschirme" and in Funkschau 52 (1980), Nos. 10 and 11 by G. Tröller: "Der flache Fernsehbildschirm". The vacuum fluorescent displays which are frequently used, owing to their brightness and long life expectany, as alphanumeric displays, have a relatively simple construction, but cannot do without control electrodes, such as grids. Liquid-crystal displays are not self-luminous, the service life of electroluminescent panels is still to short, and plasma displays have a complicated construction. German Pat. No. DE-OS 27 42 555 discloses a device which, opposite the large-surface cathode, employs expensive intermediate electrodes for deflecting the electrons, so that five construction elements are arranged above each other, with this again involving the same invenstment as a plurality of conventional gas-discharge type of display panels or screens such as, disclosed in German Pat. No. DE-AS 23 56 036. Also, the display device disclosed in German Pat. No. DE-AS 26 40 632, operating with a wide-fanned electron beam, cannot avoid the hitherto necessary invenstment in control electrodes. Moreover, the complicated controlling methods involve a rather high additional investment.

SUMMARY OF THE INVENTION

It is an object of the present invention to provide a suitable simplified construction for the above mentioned matrix arrangement, permitting a more favorable mode of operation.

A feature of the present invention is the provision of a flat-type vacuum-fluorescent display matrix comprising a vacuum housing having two parallel plates forming a portion of the housing wall thereof, at least one of the two plates being transparent; a plurality of parallel, spaced, transparent strip conductors disposed within the housing on an inner surface of the one of the two plates; a plurality of segments of fluorescent material coated on each of the plurality of transparent conductors; a plurality of parallel, spaced, second strip conductors disposed within the housing of an inner surface of the other of the two plates, the plurality of second conductors being disposed in an orthogonal relationship with the plurality of transparent conductors; and a cathode arrangement disposed in the housing between said two parallel plates.

According to the invention, for constructing an extended matrix, there is provided a strip pattern of conductor leads having segments of fluorescent material, coated thereon consisting, e.g., of a thin, transparent idium-tin oxide (ITO) film on the inside of a transparent, front wall of the display device, and is provided on the inside of the other, opposite rear wall of the housing with a strip pattern of conductors without fluorescent material segments in an orthogonal relationship with the first strip pattern. Between both patterns of strip conductors, thin filaments are provided with an emitting layer, serving as cathodes. These cathode wires are not coupled to voltage, but are at zero potential. The selection for displaying the individual fluorescent segments is by coordinate control via the conductor leads in an orthogonal relationship with one another.

Since at all points where no display is effected, the conductor leads associated with these fluorescent segments are applied to $-n \cdot U$, and all associated, perpendicularly extending conductor leads without fluorescent segments on the opposite inner surface, are applied to $+m \cdot U$, it is proposed by the invention to change the potentials of the conductor leads extending to the fluorescent segments which are intended to emit light, from $-n \cdot U$ to $+U$ and from $+m \cdot U$ to $-U$, respectively. In the inactive light-emitting cells.

In the inactive light-emitting cells, the stream of electrons from the filament cathode is displaced by the potential $-nU$ away from the fluorescent segments and flows to the non light-emitting rearward opposite electrode coupled to the potential $+mU$. The conductor leads having the fluorescent segments to be activated will receive a voltage $+U$ and the associated rearward conductor leads will receive a voltage $-U$. Accordingly, in the light-emitting cells to be activated, the electrons emitted by the cathode are forced away by the rearward electrode and attracted by the electrode coated with the fluorescent material. Sucking the non-required streams of electrons off the front side of the display carrying the fluorescent segments forms the essential part of the present invention, because only in this way it becomes possible to prevent neighboring cells form being affected.

The prior art selection of the cells to be activated merely by potential control with the aid of grid electrodes between the filament and the light-emitting area, owing to the very dense arrangement of the light-emitting areas, either causes an excessive influencing of the neighboring conductors or requires very small electrode spacings, and causes a number of unsolvable production problems.

The very simple basic cell structure of the arrangement according to the present invention permits the construction of extended display panels. Likewise, the use of coordinate control, results in favorable conditions for extending such a display, because per character, instead of z times s terminals only z plus s terminals are required, where z is equal to the number of rows of the matrix and s is equal to the number of columns of the matrix. Therefore, z equals 7 and s is equal to 5, only 12 terminals are required in the arrangement of the present invention rather than 35 terminals in the prior art arrangements. Simplicity of construction and the comparatively small number of terminal points also permits manufacturing such an arrangement having a good resolution, in which case it is then possible, for example, to construct the fluorescent dots to be smaller than 1 $mm^2$.

Depending on the practical application, when compared with conventional displays, and in accordance with the usual methods of performing the control by way of multiplexing, it is also possible with the present invention either to reduce further the number of terminals, or to enlarge the matrix display further by increasing the number of rows and/or columns.

BRIEF DESCRIPTION OF THE DRAWING

Above-mentioned and other features and objects of this invention will become more apparent by reference to the following description taken in conjunction with the accompanying drawing, in which.

DESRIPTION OF THE PREFERRED EMBODIMENT

Figure 1:
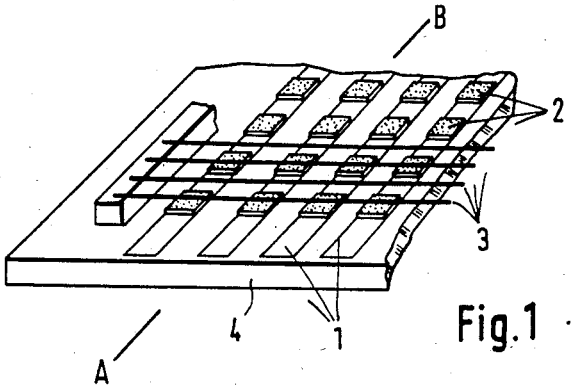
FIG. 1 is a perspective view of one corner of the transparent plate of a flat-type vacuum-fluorescent display matrix in accordance with the principles of the present invention.
Figure 2:
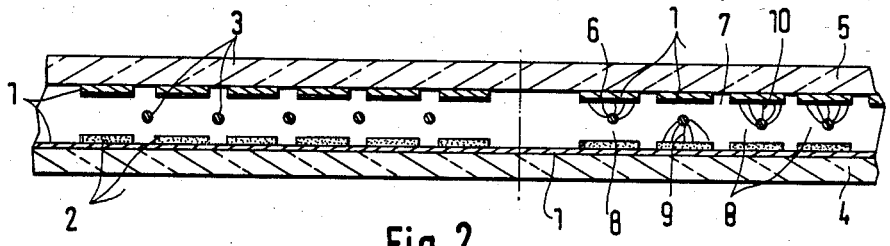
FIG. 2 is a sectional view of a flat-type vacuum-fluorescent display matrix in accordance with the principles of the present invention taken along line A-B of FIG. 1.
Figure 3:
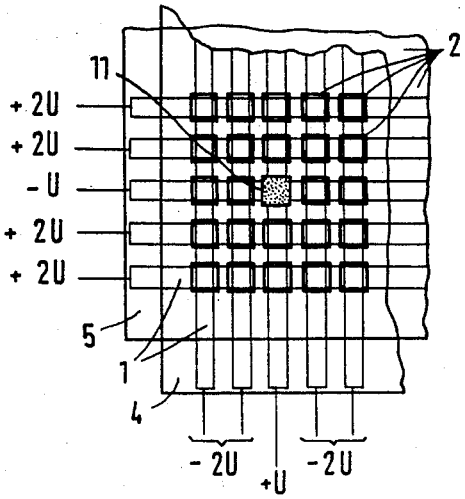
FIG. 3 is a top view of the matrix of FIGS. 1 and 2 showing the activation of a light-emitting cell.

Referring to FIG. 1 there is shown one corner of therefor a first or transparent plate 4 with the transparent conductor leads 1 which are coated with the fluorescent segments 2. The filaments 3 acting as cathodes are disposed closely thereabove. At a small spacing parallel thereabove, there is arranged the plate 5 (shown in FIG. 2) with conductor leads arranged above the rows of the fluorescent segments 2 in an orthogonal relationship with the conductor leads 1 of the first plate 4. FIG. 2 shows, schematically the flux line pattern 6 in the case of light-emitting (active) cells 7 which are in operation, and inactive cells 8. An activated light-emitting cell 11 and the potentials for cell 11 and the surrounding inactive cells, when n=2 and m=2 are shown in FIG. 3.

The fluorescent segments as indicated by the reference numeral 2 in FIGS. 1 to 3, hereinafter referred to as light spots or dots are selected ("controlled") for producing letters, figures and symbols in a suitable arrangement, and caused to emit light. Relative thereto, the dots are formed by the "miniature fluorescent screens" 2 of the plural fluorescent cells 7 and 8. The electron streams 9 and 10 coming from the filaments 3 (not shown in FIG. 3 for the sake of clarity), is controlled simply by the potentials of the conductor leads 1. The conductor leads on the inside of the "front plate" 4 are provided with the fluorescent segments while the conductor leads 1 of the "rear wall plate 5 of the housing" disposed in an orthologal relationship with the conductor leads 1 of the plate 4, only serve to trap the electron stream 10 of the non-activated cells, see FIG. 2. There is no significance for the cathode filaments 3 to be arranged exactly equally spared between the conductor leads of the plates 4 and 5.

The filaments 3 may also extend e.g., in a "zigzag'-'pattern or may have a net structure by being led backwards and forwards in different planes, or else the filament may also be mounted in a spiral-or meander-shaped manner between the plates, attached to a porous, non-conducting film or filber net.

Accordingly, by the conductor leads on plate 5, the electron stream of those particular rows which are supposed to remain dark, is being "sucked off" or attracted away from the associated fluorescent segments. In FIG. 3, the potential at the conductor leads is indicated under the assumption that n=2 and m=2.

The potential −2 U forces the electrons away from the "fluorescent screens", and the potential +2 U attract the electrons rearwardly to the non-light-emitting surfaces. In the cell 11 activated by voltages +U and −U, attraction and repulsion are reversed, so that the stream of electrons hits the "fluorescent screen".

While I have described above the principles of my invention in connection with specific apparatus it is to be clearly understood that this description is made only by way of example and not as a limitation to the scope of my invention as set forth in the objects thereof and in the accompanying claims.

I claim:

1. A flat-type vacuum-fluorescent display matrix comprising:

a vacuum housing having two spaced apart parallel plates forming opposing portions of the housing wall thereof, at least one of said two plates being transparent;

a first plurality of parallel, spaced, first strip conductors disposed within said housing on an inner surface of a first one of said two plates;

a second plurality of parallel, spaced, second strip conductors disposed within said housing on an inner surface of a second one of said two plate, said second conductors being disposed in an orthogonal relationship with respect to said first conductors, the respective intersections of said first plurality with said second plurality defining a matrix of picture point locations;

fluorescent material coated on said first strip conductors in the vicinity of each of said picture point locations;

a cathode arrangement disposed in said housing above said first plurality of said first conductors and below said second plurality of said second conductors;

means for connecting said cathode arrangement to a first potential;

means for connecting a selected one and non-selected ones of said first plurality of first strip conductors respectively to a second potential and to a third potential; and means for connecting a respective selected one and other non-selected ones of said second plurality of second strip conductors respectively to a fourth potential and a fifth potential;

wherein said second and fifth potentials are positive relative to said first potential and said third and fourth potentials are negative relative to said first potential;

whereby said fluorescent material will be excited in the vicinity of the picture point location defined by the intersection of said selected first strip conductor and said selected second strip conductor by electrons emitted from said cathode which are repulsed by said relatively negative fourth potential applied to said selected second strip conductor and attracted by said relatively positive second potential applied to said selected first strip conductor; and whereby those electrons emitted from said cathode in the vicinity of the respective said picture point locations associated respectively with said non-selected first strip conductors and with said non-selected second strip conductors will be respectively repulsed by said relatively negative third potential away from said fluorescent material and will be sucked away from said fluorescent material by said relatively positive fifth potenital.

2. The display matrix of claim 1 wherein said fifth potential is sufficiently greater than said second potential that the effective sucking force generated by said fifth potential on an electron just emitted from said cathode in the vicinity of said particular picture point location defined by the intersection of a unselected first strip conductors with said particualr selected second strip conductor will overcome the attraction force generated by said second potential.

3. The display matrix of claim 1, wherein said fluorescent material is segmented into fluorescent segments, with a separate such segment being defined at each of said picture point locations.

4. A display matrix according to claim 3, wherein said second and fifth respectively positive potentials and said third and fourth respecitvely negative potentials are coupled to said first plurality of strip conductors and said second plurality of second strip conductors in a time multiplex manner to excite several selected segments of said plurality of segments at respective picture point locations defined by a common one of said first and second plurality of first and second strip conductors, the persistence of said fluorescent material and multiplex frequency being selected to provide a flickerless display.

5. The display matrix of claim 1, wherein said first plate is transparent and each of said first plurality of strip electrodes is transparent.

6. The display matrix of claim 1, wherein said second plate is transparent and each of said second strip conductors is transparent.

7. A display matrix according to claim 1, wherein said cathode arrangement is a net of cathodes.

8. A display matrix according to calim 7, wherein said net of cathodes is disposed in several closely adjacent parallel planes.

9. A display matrix according to claim 1, wherein said first and second positive potentials and said first and second negative potentials are coupled to said plurality of transparent conductors and said plurality of second conductors in a time multiplex manner to excite several segments of said plurality of segments on the same conductor of said plurality of transparent conductors, the persistence of said fluorescent material and multiplex frequency being selected to provide a flickerless display.

10. A display matrix according to claim 1, wherein said cathode arrangement is disposed in several closely adjacent parallel planes.

* * * * *